United States Patent [19]

DeSmet

[11] Patent Number: 5,005,396

[45] Date of Patent: Apr. 9, 1991

[54] METHOD AND DEVICE FOR FORMING A SHEET-METAL BLANK IN PARTICULAR FOR MAKING A CATHODE TUBE MASK, AND CATHODE TUBE MASK OBTAINED ACCORDING TO THIS METHOD

[75] Inventor: Gabriel DeSmet, Nogent sur Oise, France

[73] Assignee: Sollac, Puteaux, France

[21] Appl. No.: 416,918

[22] Filed: Oct. 4, 1989

[30] Foreign Application Priority Data

Oct. 5, 1988 [FR] France ..... 88 13042
Jan. 18, 1989 [FR] France ..... 89 00545

[51] Int. Cl.[5] ..... B21D 22/26
[52] U.S. Cl. ..... 72/309; 72/347; 72/465
[58] Field of Search ..... 72/308, 309, 347, 348, 72/465; 313/402

[56] References Cited

U.S. PATENT DOCUMENTS 2,400,004 5/1946 Jager ..... 72/465
3,344,646 10/1967 Moller ..... 72/465
4,615,205 10/1986 Ragland, Jr. ..... 72/347

FOREIGN PATENT DOCUMENTS 123425 6/1986 Japan ..... 72/347

*Primary Examiner*—Lowell A. Larson
*Attorney, Agent, or Firm*—Fay, Sharpe, Beall, Fagan, Minnich & McKee

[57] ABSTRACT

The present invention relates to a method for forming a sheet-metal blank (1), in particular for making a cathode tube mask, on a press, according to which the peripheral part of the sheet-metal blank (1) is held over a small width in a peripheral member (30), the central part of the sheet-metal blank (1) is formed, according to a given curvature, by deforming the punch (17) and the die (13) through the action of an upper bearing plate (19), a mechanical force is exerted on localized zones of the clamping member (30), moving closer together the opposite elements of the said clamping member, and at the same time the peripheral zone of the sheet-metal blank (1) is applied and unfurled along the side walls of the punch (17) or of the die (13) by a relative movement of the clamping member (30) with respect to the punch (17) or to the die (13) so as to obtain the final flanged edge.

The invention also relates to a cathode tube mask made in accordance with this method.

20 Claims, 10 Drawing Sheets

Figure 1:
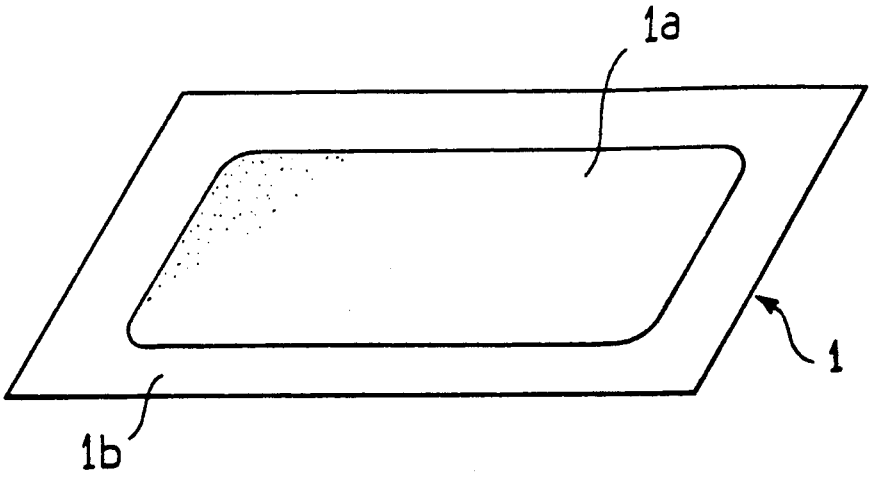

METHOD AND DEVICE FOR FORMING A SHEET-METAL BLANK IN PARTICULAR FOR MAKING A CATHODE TUBE MASK, AND CATHODE TUBE MASK OBTAINED ACCORDING TO THIS METHOD

The present invention relates to a method and a device for forming a sheet-metal blank in particular for making a cathode tube mask.

The invention also relates to a cathode tube mask obtained according to this method.

In a conventional method of forming a sheet-metal blank, the sheet-metal blank is held by means of its central part and the central part of the said blank is subjected to the downward or upward action of a punch which gradually forms the blank while flanging the peripheral edge. In this method, the peripheral part undergoes a retraction in view of the reduction in the perimeter, which occurs from the outside, while the central part expands. In order to avoid the formation of folds, the pressure during clamping of the blank is therefore increased, thus resulting in an increase in the tensile force which is to be exerted on the central part, according to the peripheral forces, and consequently elongation of the metal in this part.

However, this is unacceptable for certain applications where any deformation through elongation cannot be tolerated, in particular in the case of extra-thin and/or perforated metal sheets in particular for cathode tube masks.

In fact, it is known that the masks for cathode tubes are made from an extra-thin sheet-metal blank having in its central part a network of microscopic perforations, which must be able to satisfy extremely rigorous requirements as regards the positioning and shape of the perforations.

Hitherto, cathode tube masks are made by means of conventional swaging of the central part with a punch and die, by heating the peripheral part of the sheet-metal blank to a temperature suitable for making the latter more ductile and hence promoting deformation thereof, while limiting the tensile force in the central part.

However, heating has the drawback of causing the appearance of oxides and of requiring pickling and cooling of the central part of the sheet-metal blank.

Moreover, in order to take into account the elongation of the metal due to the action of the punch in the swaging operation, it was necessary to provide the microscopic perforations, formed by means of a chemical attack method on the sheet-metal blank, with a specific initial shape such that the said perforations, after swaging, have the desired shape.

The object of the present invention is to provide a cold-working method for forming a sheet-metal blank and achieving, in a single operation, the curvature of the central part and flanging or raising of the peripheral zone of the sheet-metal blank, without deforming the network of perforations, while avoiding the drawbacks of the heat supply mentioned previously.

The energy of the peripheral deformation is therefore no longer of thermo-mechanical origin, but of mechanical origin.

The invention thus relates to a method for forming a sheet-metal blank, in particular for making a cathode tube mask, on a press, characterized in that:

the sheet-metal blank is arranged between a deformable punch and a deformable die, the peripheral part of the sheet-metal blank is held over a small width in a peripheral clamping member, the central part of the sheet-metal blank is clamped between the deformable punch and the deformable die, the central part of the sheet-metal blank is formed, according to a given curvature, by deforming the punch and the die through the action of an upper bearing plate so as to place the mean axis of the sheet-metal blank in a given position, relative to the neutral axis of the punch and die assembly, such that it is possible to produce, at least in localized zones of the said sheet-metal blank, an adjustable internal stress, a mechanical force is exerted on localized zones of the clamping member, moving closer together the opposite elements of the said clamping member so as to produce on the free part of the sheet-metal blank situated between the punch and the clamping member, controlled buckling directed by a thrusting force on the peripheral part of the sheet-metal blank, while ensuring that the thickness and perimeter of the said sheet-metal blank remain substantially constant, and at the same time the peripheral zone of the sheet-metal blank is applied and unfurled along the walls of the punch or the die, by a relative movement of the clamping member with respect to the punch or to the die so as to obtain the final flanged edge.

The invention also relates to a device for forming a sheet-metal blank, in particular for making a cathode tube mask, on a press comprising a die and a punch, characterized in that the die and the punch are made of a deformable material and in that it comprises a member for clamping the periphery of the sheet-metal blank, means for exerting in localized zones a mechanical force on the clamping member, moving closer together the opposite elements of the clamping member, means for relative displacement of the clamping member with respect to the punch or to the die, and complementary means for controlling the buckling and for unfurling the peripheral part of the sheet-metal blank along side walls of the punch or of the die so as to obtain the final flanged edge.

The invention also relates to cathode tube mask made in accordance with the abovementioned method.

Figure 2:
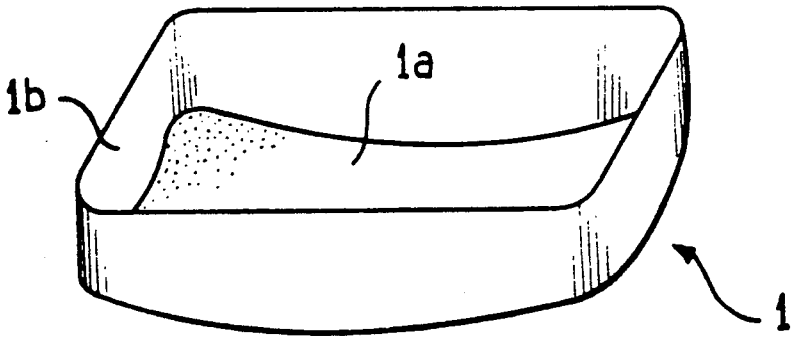
Figure 3:
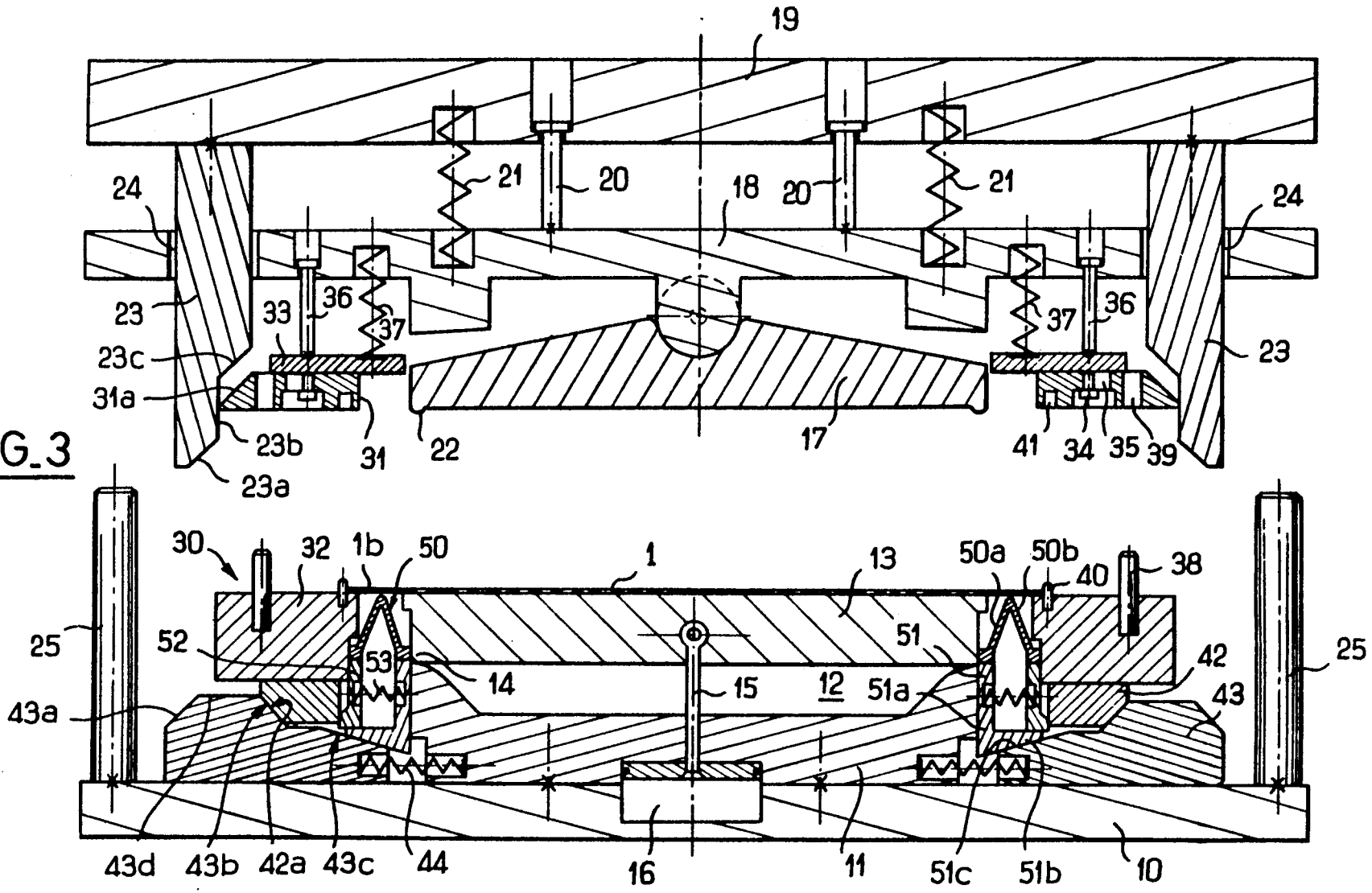
Figure 4:
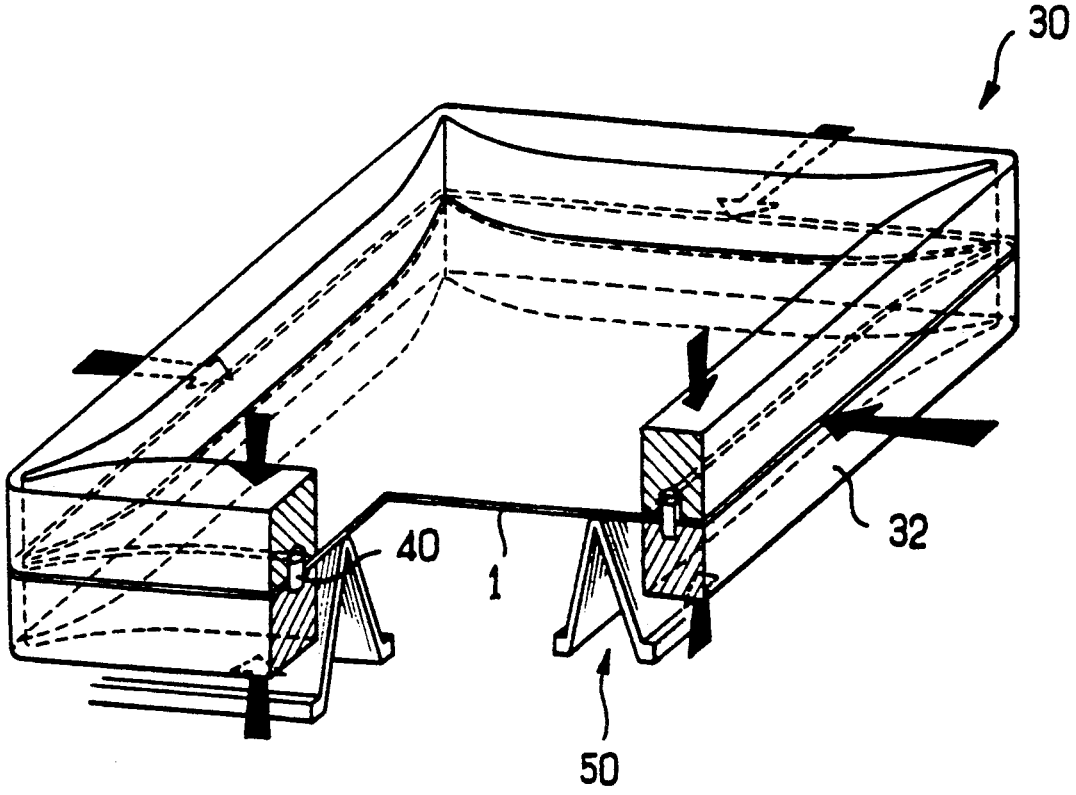

The invention will be better understood with the aid of the description which follows, provided solely by way of example with reference to the attached drawings in which:

FIG. 1 is a perspective view of the sheet-metal blank from which a cathode tube mask is made, FIG. 2 is a perspective view of a mask after forming, FIG. 3 is a sectional view of the device according to the invention, FIG. 4 is a perspective diagrammatic view of the member for clamping the peripheral part of the sheet-metal blank and means for directing the buckling of the free part of the said blank, FIGS. 5 to 11 are sectional views showing the successive stages of forming a mask.

FIG. 1 shows a sheet-metal blank 1 of very small thickness from which a cathode tube mask is made. This sheet-metal blank has a central part 1*a* provided with a network of microscopic perforations and a peripheral part 1b which is not perforated.

The central part 1a of the mask made after forming, corresponding to the network of microscopic perforations, is therefore curved and its peripheral edge 1b raised, as can be seen in FIG. 2.

The forming device shown in FIG. 3 for making a cathode tube mask comprises a lower bearing plate 10 on which a die bottom piece 11 rests. This die bottom piece 11 is provided in the centre with an impression 12.

Above the die bottom piece 11, the forming device comprises a deformable die 13, preferrably made of an elastomer, which rests on the die bottom piece 11 with its peripheral edge 14.

The die 13 is connected by a pin 15 to a locking system 16 consisting for example of a jack.

The forming device also comprises a deformable punch 17, also preferrably made of an elastomer, supported by a middle bearing plate 18 which is itself supported by an upper bearing plate 19 via small columns 20 mounted slidably in the said upper bearing plate. Compression springs 21 are arranged between the two bearing plates 18 and 19.

The die 13 and the punch 17 are made of deformable material, such as an elastomer, and the lower face of the punch 17 may have a peripheral 22 intended to prevent sliding of the sheet-metal blank towards the outside during forming thereof.

Furthermore, the upper bearing plate 19 supports cams 23 which pass through the bearing plate 18 via the openings 24.

Each cam 23 has on its lower face specific profiles 23a, 23b and 23c.

The vertical travel of the middle bearing plate 18 and consequently of the punch 17 is limited by columns 25 mounted on the lower bearing plate 10.

The forming device comprises, around the die 13 and the punch 17 and at the level of the plane of separation of these two elements, a peripheral clamping member 30 intended to clamp the peripheral part 1b of the sheet-metal blank 1 over a small width. This clamping member 30 made for example of composite material consists of an upper jaw 31 and of a lower jaw 32 and has the shape of a frame, as shown in FIG. 4.

The upper jaw 31 is supported by a table 33 via screws 34 arranged inside oblong holes 35 provided in the upper jaw 31, so as to allow lateral displacement of the said jaw relative to the table 33. This table 33 is supported by the middle bearing plate 18 via small columns 36 mounted slidably inside the said bearing plate. Compression springs 37 are arranged between the table 33 and the middle bearing plate 18.

Finally, the upper jaw 31 has an inclined lateral face 31a intended to cooperate with the inclined face 23c of the cams 23 so as to exert, in localized zones, a lateral mechanical force on the clamping member 30.

The lower jaw 32 also has on the one hand guiding pins 38 intended to penetrate into holes 39 provided inside the upper jaw 31 and on the other hand studs 40 uniformly distributed on the circumference of the jaw 32 and intended to centre the sheet-metal blank 1. The studs 40 penetrate into holes 41 provided in the upper jaw 31 when the clamping member 30 is closed.

The lower jaw 32 is supported by a frame 42 resting on counter-cams 43 which themselves bear against the lower bearing plate 10. The frame 42 has an external inclined face 42a.

Each counter-cam 43 has on its upper face a first inclined face 43a intended to cooperate with the inclined face 23a of the cams 23, a second inclined face 43b intended to cooperate with the inclined face 42a of the frame 42, and a third inclined face 43c intended to cooperate with complementary means 50 in order to direct the buckling, as will be seen subsequently.

Spring 44 are arranged between the die bottom piece 11 and each counter-cam 43.

The complementary means for directing the buckling may consist of a deformable peripheral lamina 50, inserted between the die 13 and the lower jaw 32 in order to direct the buckling of the free part lb of the sheet-metal blank 1 in a uniform manner and in the same direction.

The lamina 50 consists of a resilient lamina made for example of composite material.

According to an embodiment illustrated in the present application, a first part 50a of the lamina 50 bears against a frame-shaped support 51 surrounding the die bottom piece 11. The support 51 has a vertical wall plate 51a in contact with the external wall of the die bottom piece 11 and a horizontal base plate 51b contiguous with an edge of the wall plate, forming a right angle with the latter. The lower face 51c of the base plate 51b is inclined at the same angle as the inclined face 43c of the counter-cams 43.

A second part 50b of the lamina 50 bears against a push-piece 52 formed by a vertical plate, the bottom end of which rests on the base plate 51b of the support 51. Springs 53 are arranged between the wall plate 51a and the plate 52 so as to keep the said plates separated and bearing respectively against the external wall of the die bottom piece 11 and against the internal side wall of the lower jaw 32.

In the embodiment illustrated, the lamina 50 has been shown underneath the sheet-metal blank 1, which results in raising of the edge, but it is obvious that it is possible to conceive of a symmetrical version in which the edge is flanged by means of a lamina arranged above the blank and to which a descending movement is imparted.

Forming of the sheet-metal blank 1 is performed as follows.

Firstly, the sheet-metal blank 1 is placed on the die 13 so that a small width of its peripheral edge also rests on the lower jaw 32 inside the zone bounded by the studs 40.

Figure 5:
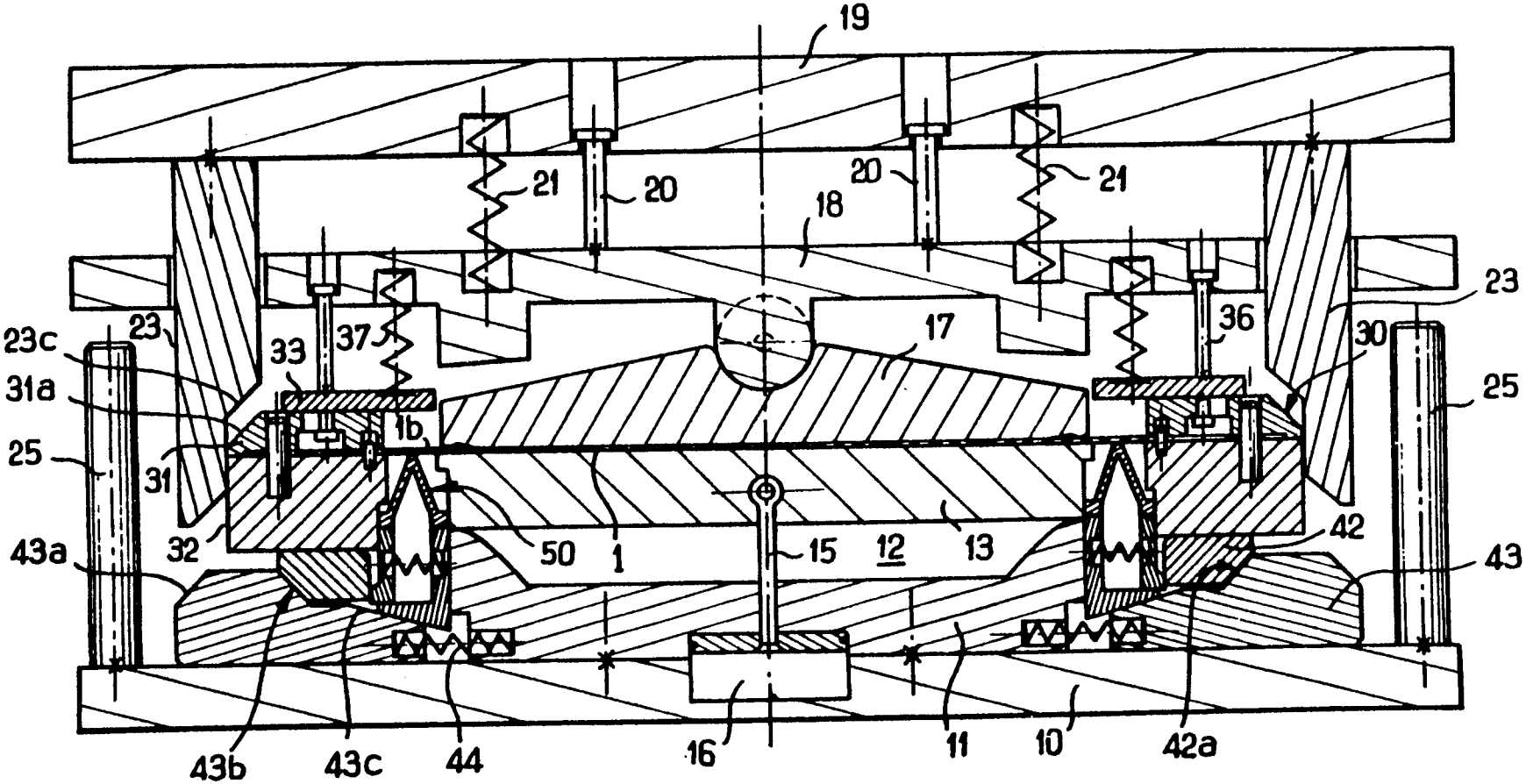

Through the action of a slide, not shown, of the press which acts on the upper bearing plate 19, the upper part of the device is lowered so as to apply the punch 17 onto the sheet-metal blank 1 and close the clamping member 30 so as to hold a small width of the peripheral part of the said blank between the jaws 31 and 32 (FIG. 5). The guiding pins 38 and the studs 40 penetrate into the holes 39 and 41, respectively, of the upper jaw 31.

Figure 6:
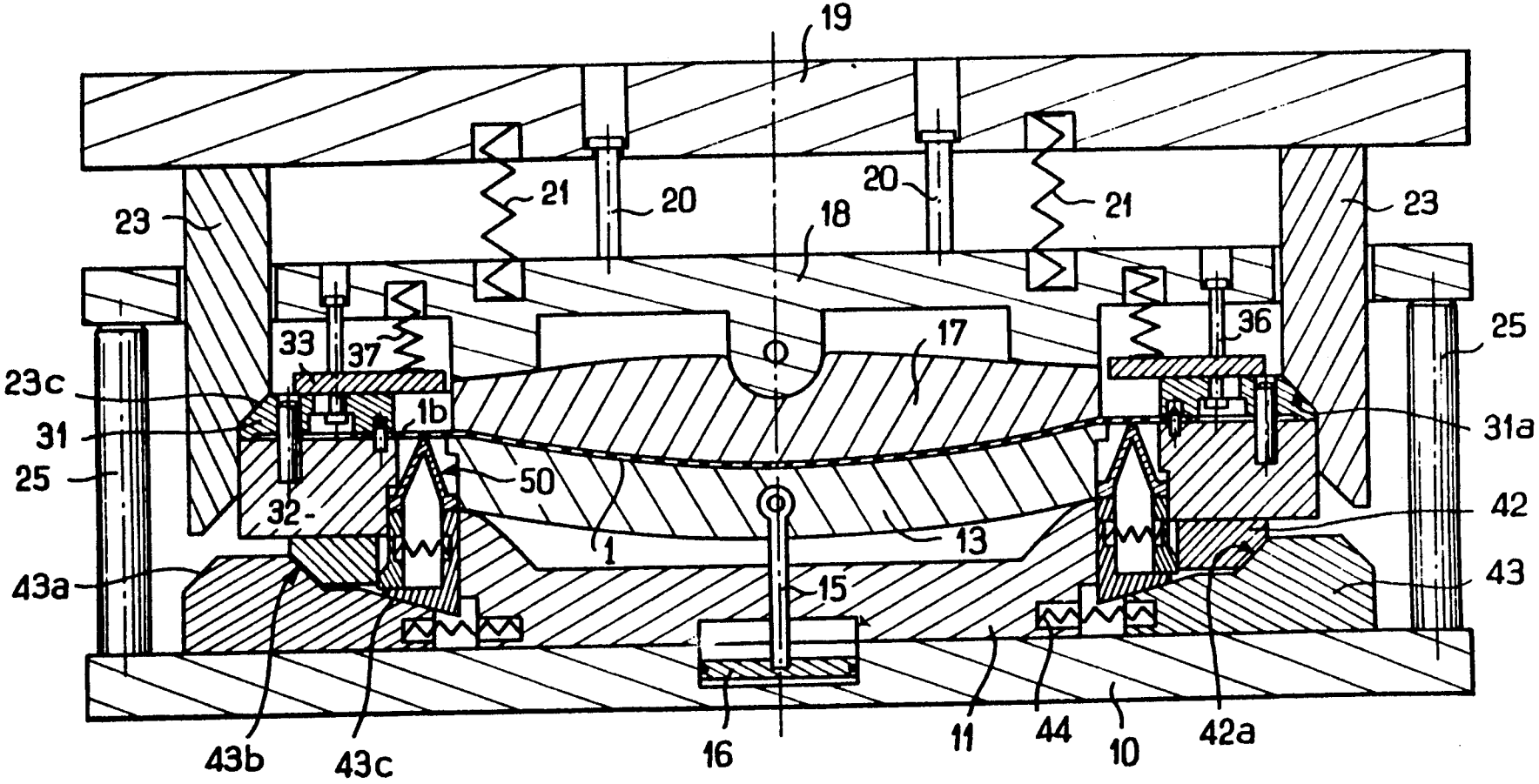

Still through the action of the slide of the press, the deformable punch 17 and the deformable die 13 are made to flex by means of the bearing plates 18 and 19 so as to form, thus, the desired curvature of the central part of the sheet-metal blank 1. This position is maintained by the jack 16 at the bottom dead centre (FIG. 6). The bead 22 prevents any sliding of the sheet-metal blank.

Through the action of the compression spring 37 and the table 33, the upper jaw 31 is pressed against the lower jaw 32 kept in position by the frame 42 and the counter-cams 43. The peripheral part of the sheet-metal blank 1 is thus clamped.

During this stage of forming of the central part, the actual mean axis of the sheet-metal blank is placed in a position relative to the neutral axis of the assembly constituted by the punch 17 and the die 13 such that it is possible to produce, at least in localized zones of the said sheet-metal blank, an adjustable internal stress available for eliminating any stresses induced by external phenomena such as thermal expansion and vibration generated by acoustic, magnetic and other phenomena.

Thus, by modifying the position of the sheet-metal blank relative to the neutral axis of the punch 17 and die 13 assembly, it is possible to produce, at least in localized zones of the sheet-metal blank, internal compressive or tensile stresses depending on the subsequent use of the part formed.

Moreover, deformation is performed relative to the mean axis of the metal constituting the sheet-metal blank so as to ensure homogeneous deformation and so as not to impair the precision of the microscopic perforations of the central part of the sheet-metal blank.

During this stage of forming the curvature, the top part of the lamina 50 is bearing underneath the peripheral zone 1*b* of the sheet-metal blank (FIG. 6).

At the end of this stage in which the curvature is formed, the free part 1*b* of the sheet-metal blank situated between the punch 17 and the clamping member 30 is buckled in a controlled manner.

For this purpose, with the middle bearing plate 18 being in abutment against the columns 25 and while holding by means of the clamping member 30 the peripheral part 1*b* of the sheet-metal blank 1 through the action of the springs 37, a mechanical force illustrated by the arrows F1 (FIGS. 7 to 9) is exerted on localized zones of the jaws 31 and 32 of the clamping member 30.

Figure 7:
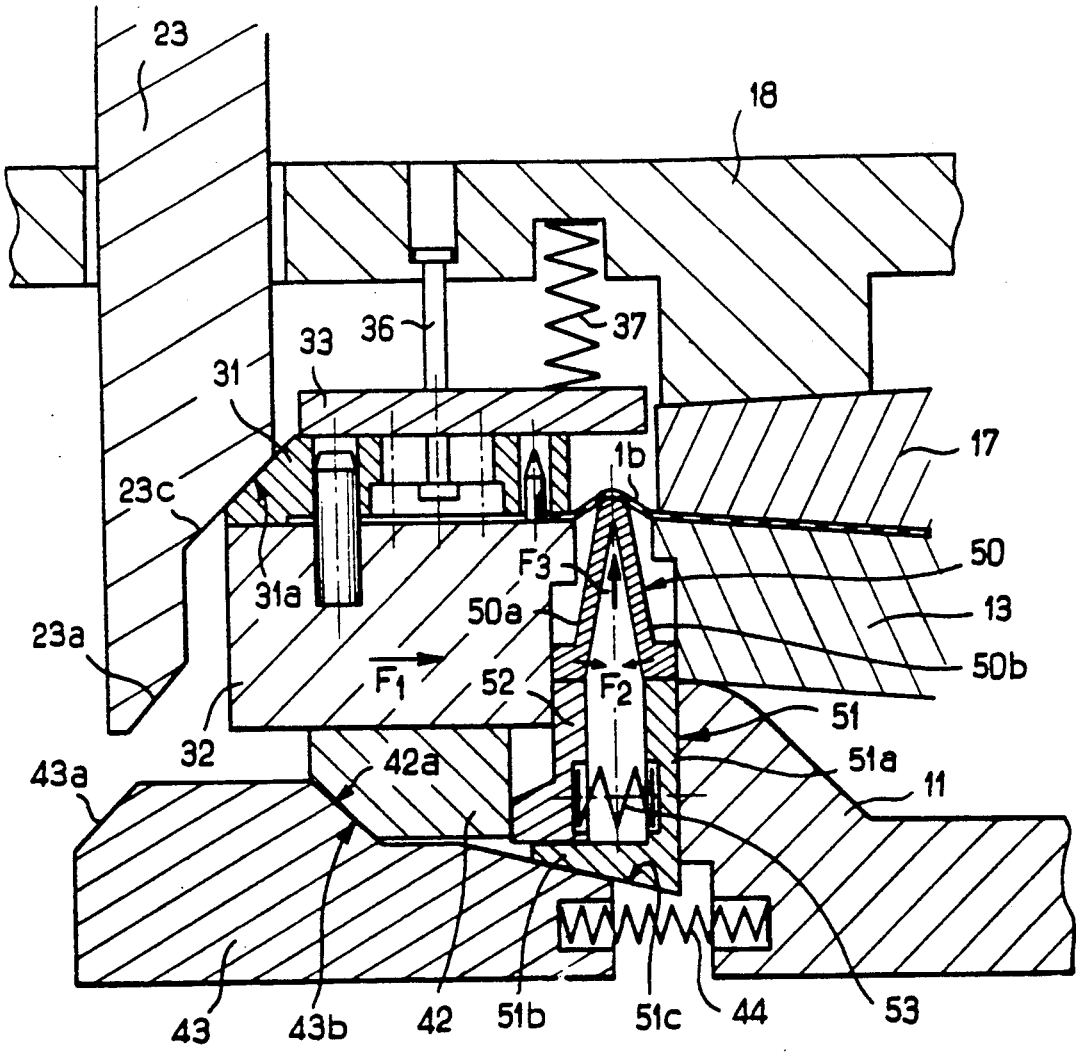
Figure 8:
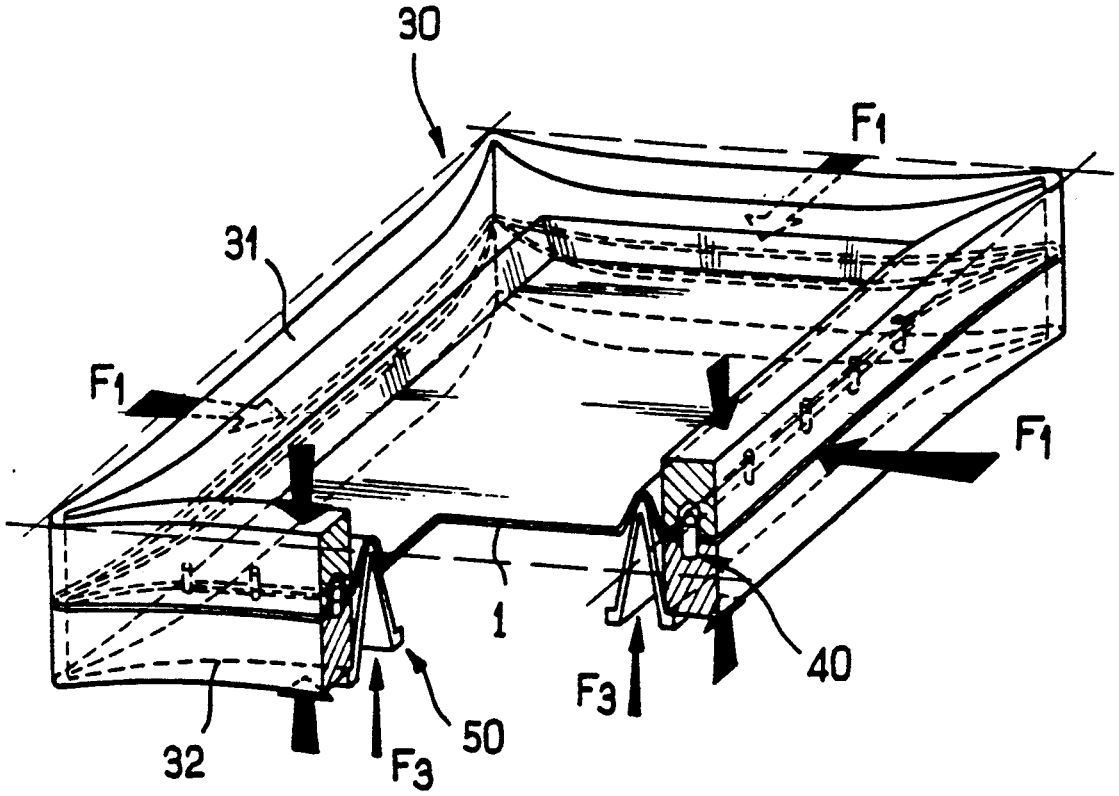
Figure 9:
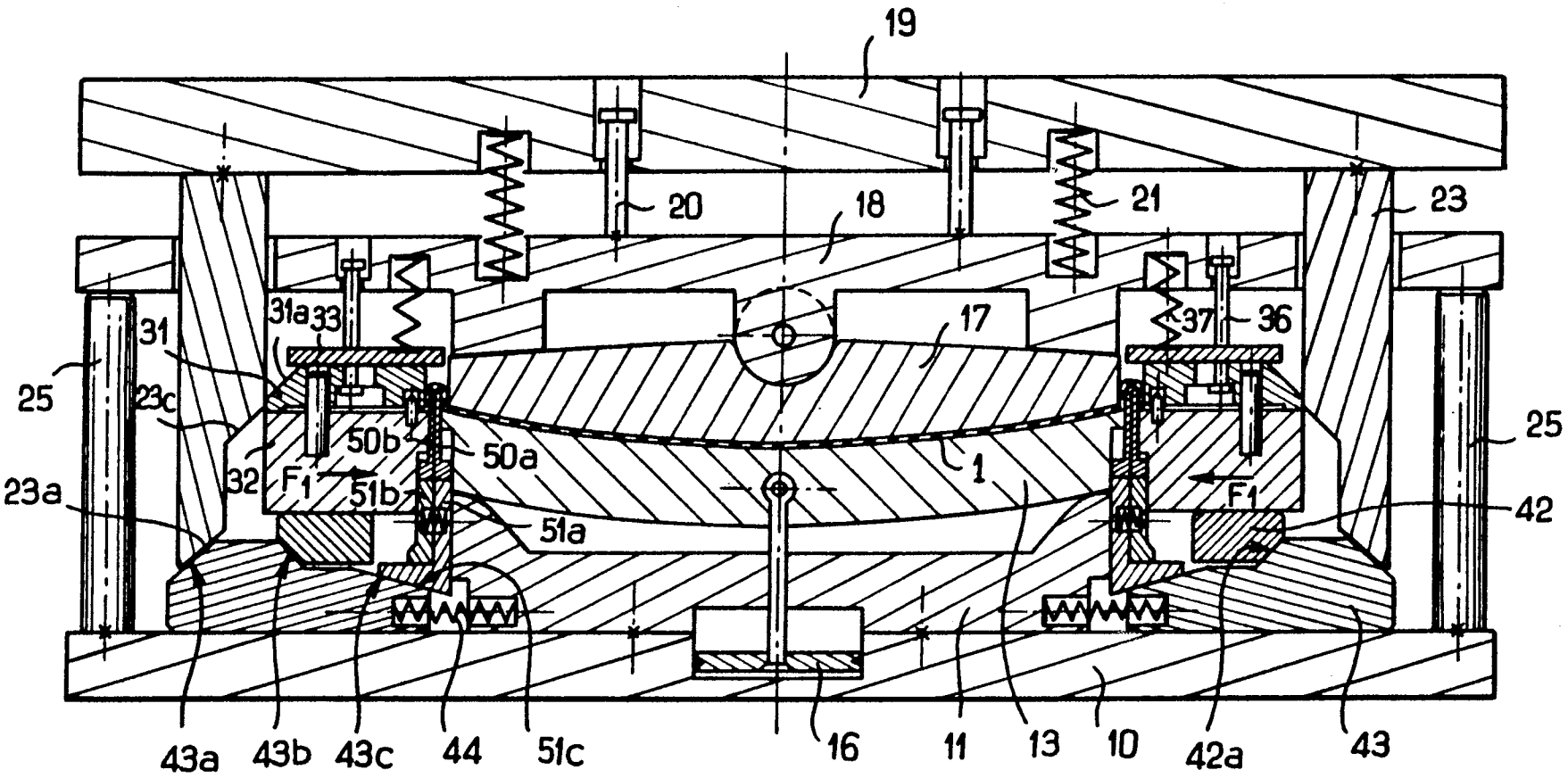

This mechanical force is achieved by lowering the cams 23 by means of the upper bearing plate 19 such that the inclined face 23*c* of the said cams comes into contact with the inclined face 31*a* of the upper jaw 31, which has the effect of moving closer together the opposite arms of the clamping member 30 (FIGS. 7 to 9).

Moreover, this mechanical force on each opposite arm of the clamping member 30 has the effect of inducing by means of small studs 40 a thrusting action on the peripheral part of the sheet-metal blank which is entirely original compared to a conventional swaging operation performed through the tensile force exerted by the blank beneath the punch.

Thus, the movement towards each other of the opposite arms of the clamping member 30 causes controlled buckling on the free part 1*b* of the sheet-metal blank 1. This directed buckling occurring around the mean axis of the sheet-metal blank is performed such that deformation of the peripheral zone of the sheet-metal blank corresponds to a flowing movement of the material, such that the thickness of the blank and the perimeter of the latter remain substantially constant.

During this mechanical action on the clamping element 30, the opposite arms of the jaws 31 and 32 are deformed as can be seen in FIG. 8. The edges of the sheet-metal blank 1 are pushed by the studs 40.

This mechanical action also causes a simultaneous movement together of the two parts 50*a* and 50*b* of the lamina 50 illustrated by the arrows F2 and an upward movement of the lamina 50 illustrated by the arrow F3 (FIGS. 7 and 8).

This combined upward movement and movement together of the lamina 50 has the function of directing buckling of the free part 1*b* of the sheet-metal blank 1 situated between the punch and die assembly and the clamping member 30.

Figure 10:
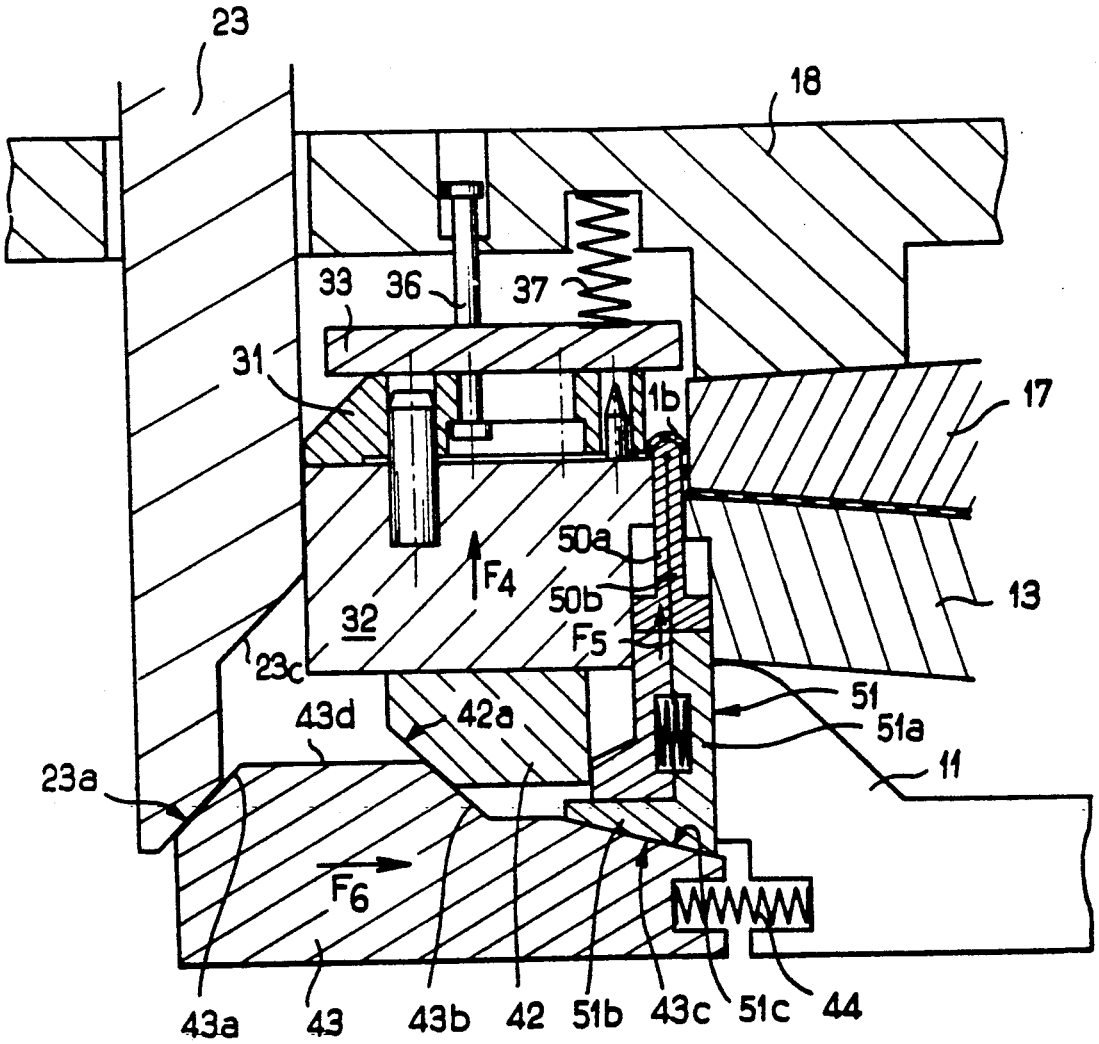

The downward movement of the upper bearing plate 19 and the cams 23 is continued by means of the slide of the press, and the inclined lower face 23*a* of the said cams comes into contact with the inclined face 43*a* of the counter-cam 43. The clamping member and the lamina 50 are kept in an adjacent position, as shown in FIGS. 9 and 10, by the side wall of the cams 23.

The next stage of the method (FIGS. 10 and 11) consists in unfurling of the edge 1*b* of the sheet-metal blank 1 by translation in a simultaneous upwards movement of the clamping member 30 and the lamina 50, respectively, in the direction of the arrows F4 and F5.

For this purpose, the downward movement of the upper bearing plate 19 and of the cams 23 is continued.

The cams 23 impart by means of the inclined faces 23*a* and 43*a* a transverse movement to the counter-cams 43 against the springs 44. The transverse movement F6 of the counter-cams 43 in turn imparts simultaneously an upward movement F4 to the clamping member 30, by means of the inclined face 43*b* of the said counter-cams and the inclined face 42*a* of the frame 42, and an upward displacement F5 to the lamina 50 by means of the inclined face 43*c* of the counter-cams and the inclined face 51*c* of the support 51.

The slope of the inclined face 43*b* is greater than that of the inclined face 43*c* so as to obtain vertical displacement of the clamping member 30 more rapidly than that of the lamina 50.

During the final stage of finishing of the edges, the end of the free edge 1*b* of the sheet-metal blank 1 is pressed against the side wall of the punch 17 by the upward movement of the lamina 50.

Figure 11:
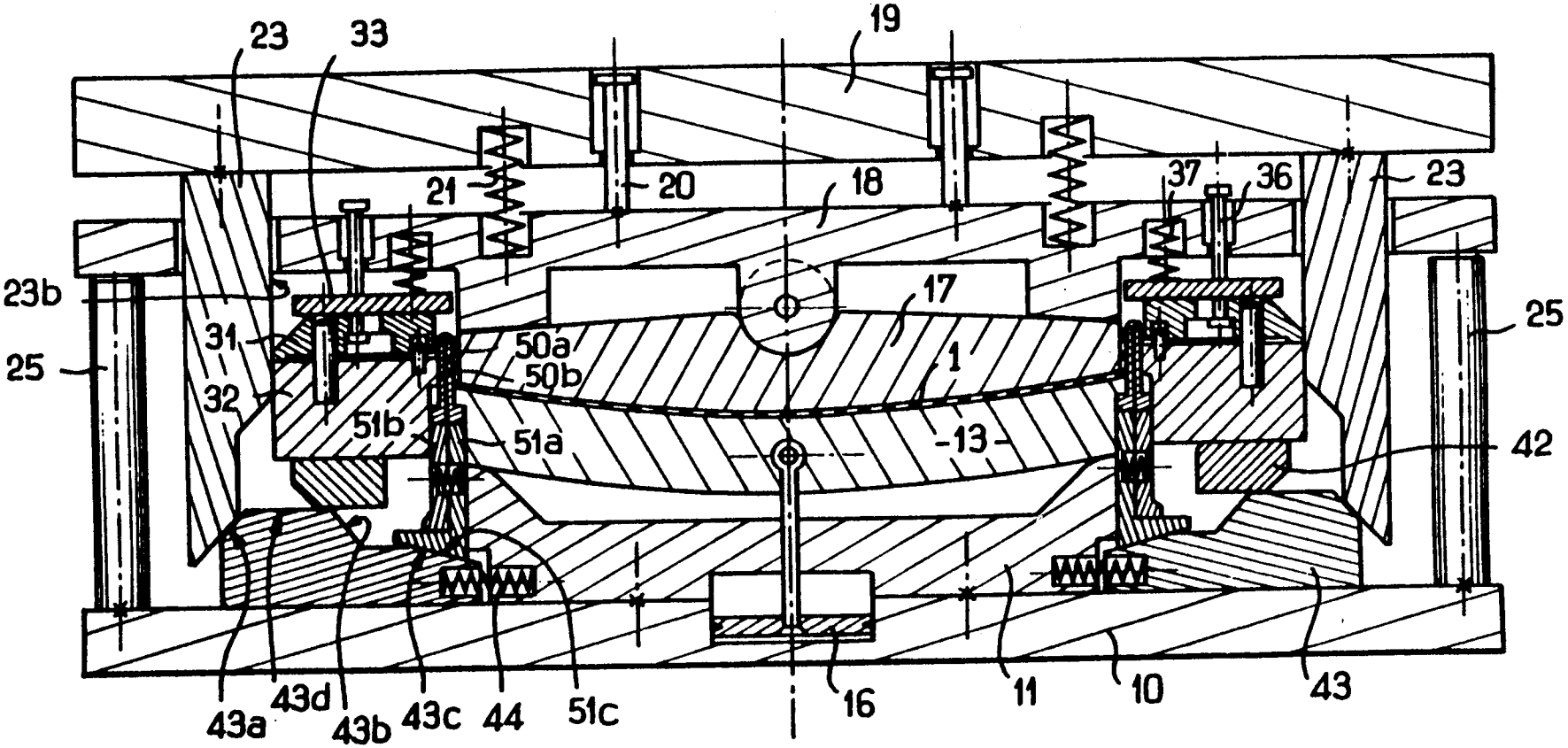

For this purpose, the downward movement of the upper bearing plate 19 and the cams 23 is continued so as to continue the transverse displacement of the counter-cams 43. The frame 42 escapes above the inclined face 43*b* of the counter-cams 43 so as to pass onto the upper face 43*d*, thereby stopping the upward movement of the clamping member 30. The lamina 50, however, continues to move upwards such that the end of the free edge 1*b* of the sheet-metal blank 1 is pressed against the side wall of the punch 17 (FIG. 11).

Then, the upper bearing plate 19 is raised, thus causing the device to open as a result of the upward movement of the cams 23, the middle bearing plate 18, the punch 17 and the upper jaw 31.

As a result of the action of the springs 44 and 53, the counter-cams 43, the lower jaw 32 and the lamina 50 resume their initial position.

The jack 16 is always kept at the bottom dead centre so as to prevent the upward movement of the die 13, which would cause deformation of the formed sheet-metal blank 1.

Finally, the end of the edge of the sheet-metal blank may be trimmed by a suitable device.

I claim:

1. Method for forming a sheet-metal blank (1), in particular for making a cathode tube mask, on a press, comprising:

arranging the sheet-metal blank (1) between a deformable punch (17) and a deformable die (13), holding a peripheral part of the sheet-metal blank (1) over a small width in a peripheral clamping member (30), clamping a central part of the sheet-metal blank (1) between the deformable punch (17) and the deformable die (13), forming the central part of the sheet-metal blank (1), according to a given curvature, by deforming the punch (17) and the die (13) through the action of an upper bearing plate (19) so as to place a mean axis of the sheet-metal blank (1) in a given position, relative to a neutral axis of the punch (17), the die (13) and a press assembly which holds the punch and die, such that it is possible to produce, at least in localized zones of the sheet-metal blank (1), an adjustable internal stress, exerting a mechanical force on localized zones of the clamping member (30), moving closer together the opposite elements of the clamping member so as to produce on the peripheral part (1*b*) of the sheet-metal blank (1) situated between the punch (17) and die (13) assembly and the clamping member (30), a controlled buckling directed by a thrusting force on the peripheral part of the sheet-metal blank (1), while ensuring that the thickness and perimeter of the sheet-metal blank remain substantially constant, simultaneously applying and unfurling a peripheral zone (1*b*) of the sheet-metal blank (1) along the walls of the punch (17) or the die (13), by a relative movement of the clamping member (30) with respect to the punch (17) or to the die (13) so as to obtain a final flanged edge.

2. Method according to claim 1, characterized in that, during buckling of the peripheral part (1*b*) of the sheet-metal blank (1), the deformation of the peripheral part is directed.

3. Device for forming a sheet-metal blank (1), in particular for making a cathode tube mask, comprising:

a press receiving a die (13) and a punch (17) supported by an upper bearing plate (19) via a middle bearing plate (18), wherein the die (13) and the punch (17) are made of a deformable material;

a member (30) for clamping a periphery of the sheet-metal blank (1), means (23) for exerting in localized zones a mechanical force on the clamping member (30), moving closer together opposite elements of the clamping member (30), means (23, 42, 43) for relative displacement of the clamping member (30) with respect to the punch (17) and die (13) assembly, and complementary means (50) for controlling the buckling and for unfurling a peripheral part of the sheet-metal blank along side walls of the punch (17) or of the die (13) so as to obtain a final flanged edge.

4. Device according to claim 3, characterized in that the member (30) for peripheral clamping of the sheet-metal blank (1) has the shape of a frame.

5. Device according to claim 3, characterized in that the member (30) for peripheral clamping consists of an upper jaw (31) supported by the middle bearing plate (18) and a lower jaw (32).

6. Device according to claim 5, characterized in that the lower jaw (32) is provided in the region of its upper peripheral edge with an inclined face (31*c*).

7. Device according to claim 3 characterized in that the means for exerting in localized zones a mechanical force on the clamping member (30) comprises cams (23) supported by the upper bearing plate (19).

8. Device according to claim 7, characterized in that the cams (23) have an inclined lower face (23*a*) and a recessed part (23*b*) provided with an inclined face (23*c*) cooperating with an inclined face (31*c*) of a jaw (31) of the clamping member.

9. Device according to claim 7, characterized in that the means for vertical displacement of the clamping member (30) comprises counter-cams (43) cooperating with the cams (23) and a frame (42) arranged between said counter-cams (43) and said clamping member (30).

10. Device according to claim 9, characterized in that the counter-cams (43) are movable in a direction perpendicular to the direction of displacement of the cams (23).

11. Device according to claim 9, characterized in that the counter-cams (43) have on their upper wall a succession of several inclined faces (43*a*, 43*b*, 43*c*) of varying direction and inclination.

12. Device according to claim 9, characterized in that the frame (42) is provided in the region of its external peripheral edge with an inclined face (42*a*) having the same inclination as an inclined face (43*a*) of the counter-cams (43).

13. Device according to claim 3, characterized in that the complementary means for controlling buckling of the peripheral part (1*b*) of the sheet-metal blank (1) comprises a deformable peripheral lamina (50).

14. Device according to claim 13, characterized in that the deformable peripheral lamina (50) comprises a resilient element, a first part (50*a*) of which bears against the die (13) and a second part (50*b*) of which bears against the clamping member (30).

15. Device according to claim 14, characterized in that the first part (50*a*) of the lamina (50) rest on a frame-shaped support (51).

16. Device according to claim 15, characterized in that the support (51) comprises a vertical wall plate (51*a*) and a horizontal base plate (51*b*) contiguous with an edge of said wall plate and forming a right angle with the latter.

17. Device according to claim 16, characterized in that the base plate (51*b*) has a lower face (51*c*) inclined substantially at the same angle as the inclined face (43*c*) of the counter-cams (43).

18. Device according to claim 16, characterized in that the second part (50*b*) of the lamina (50) bears against a push-piece (52) formed by a vertical plate, the bottom end of which rests on the base plate (51*b*) of the support (51).

19. Device according to claim 18, characterized in that springs (53) are arranged between the wall plate (51*a*) of the support (51) and the push-piece (52).

20. Device according to claim 3, further comprising a means (15, 16) for locking the die (13) at a bottom dead centre location.

* * * * *